US006462001B1

(12) United States Patent
Kenbeek et al.

(10) Patent No.: US 6,462,001 B1
(45) Date of Patent: Oct. 8, 2002

(54) COMPLEX ESTERS, FORMULATIONS COMPRISING THESE ESTERS AND USE THEREOF

(75) Inventors: Dirk Kenbeek, Oudewater; Cornelis Verboom, Gouda; Gijsbert Van der Waal, Bergambacht, all of (NL)

(73) Assignee: Unichema Chemie BV, Gouda (NL)

( * ) Notice: Subject to any disclaimer, the term of this patent is extended or adjusted under 35 U.S.C. 154(b) by 0 days.

(21) Appl. No.: 09/541,166

(22) Filed: Mar. 31, 2000

Related U.S. Application Data

(63) Continuation of application No. PCT/EP98/06145, filed on Sep. 28, 1998.

(51) Int. Cl.[7] ..... C10M 105/44; C10M 105/42

(52) U.S. Cl. ..... 508/492; 508/485; 252/79; 560/199; 44/398

(58) Field of Search ..... 508/492

(56) References Cited

U.S. PATENT DOCUMENTS

| | | | | | |
|---|---|---|---|---|---|
| 4,113,642 | A | * | 9/1978 | Koch et al. | 508/492 |
| 4,157,990 | A | * | 6/1979 | Lindner et al. | 508/492 |
| 5,057,247 | A | * | 10/1991 | Schmid et al. | 508/492 |
| 5,503,762 | A | * | 4/1996 | Bongardt et al. | 508/492 |
| 5,674,822 | A | * | 10/1997 | Schlosberg et al. | 508/485 |
| 5,750,750 | A | * | 5/1998 | Duncan et al. | 554/117 |
| 5,922,658 | A | * | 7/1999 | Duncan et al. | 508/492 |
| 5,942,475 | A | * | 8/1999 | Schlosberg et al. | 508/492 |
| 5,750,750 | C1 | * | 3/2001 | Duncan et al. | 554/117 |

FOREIGN PATENT DOCUMENTS

| | | |
|---|---|---|
| DE | 26 20 645 | 12/1976 |
| EP | 0 415 778 | 3/1991 |
| EP | 0 535 990 | 4/1993 |
| EP | 0 578 435 | 1/1994 |
| GB | 1 460 665 | 1/1977 |
| WO | 94 01516 | 1/1994 |

OTHER PUBLICATIONS

Database WPI, Section Ch, Week 7850 Derwent Publications Ltd., London, GB; AN78–90446A XP002093831 & JP 53 127970 A (Nippon Oils & Fats Co Ltd), Nov. 8, 1978 see abstract.

Patent Abstracts of Japan vol. 014, No. 208 (C–0714), Apr. 27, 1990 & JP 02 045595 A (KAO Corp), Feb. 15, 1990 see abstract.

Patent Abstracts of Japan vol. 095, No. 005, Jun. 30, 1995 & JP 07 034080 A (KOA Corp), Feb. 3, 1995 see abstract.

* cited by examiner

*Primary Examiner*—Ellen M. McAvoy
(74) *Attorney, Agent, or Firm*—Pillsbury Winthrop LLP

(57) ABSTRACT

An ester resulting from an esterification reaction between at least one polyfunctional alcohol and at least one polyfunctional carboxylic acid using a chain stopping agent to form ester bonds with the remaining hydroxyl or carboxyl groups is disclosed. The polyfunctional carboxylic acid comprises an aliphatic dicarboxylic acid containing from 9 to 18 carbon atoms, dimerised and/or trimerised fatty acids or mixtures thereof, with the proviso that dimerised and trimerised fatty acids do not constitute more than 80% by weight of the total amount of polyfunctional carboxylic acid used. The chain stopping agent may be a monocarboxylic acid or a monofuntional alcohol having at least 14 carbon atoms. The complex esters have a kinematic viscosity at 100 C of from 30 to 1000 cSt, preferably from 30 to 200 cSt. The complex ester is useful "as is" or as an additive and/or as a base fluid and/or a thickener in transmission oils, hydraulic fluids, four-stroke oils, fuel additives, compressor oils, grease, chain oils and for metal working metal rolling applications. A multigrade gear oil formulation comprising one of more of the above complex esters is also part of the invention.

29 Claims, No Drawings

COMPLEX ESTERS, FORMULATIONS COMPRISING THESE ESTERS AND USE THEREOF

This is a continuation under 35 U.S.C. Section 120 of International application Serial Number PCT/EP98/06145 filed on Sep. 28, 1998 which application designates the US.

The present invention relates to esters containing more than one ester linkage, hereinafter known as "complex" esters, to formulations comprising one or more of these complex esters and to various uses of the complex esters and the formulations. More specifically, the present invention relates to complex esters and their use as an additive and/or a base fluid and/or thickener in various types of formulations suitable for use in lubrication applications, for example gear oils, hydraulic fluids, compressor oils, greases and four-stroke oils. The present invention also relates to formulations comprising one or more of these complex esters.

Complex esters are known in the art. For instance, DE-A-2620645 discloses a process for lubricating a two stroke engine by using a two stroke lubricating oil of which the base oil consists of at least one hydrocarbon oil and a complex ester. The complex ester results from esterification of trimethylolpropane with at least one saturated, linear or slightly branched $C_4$–$C_{36}$ saturated, aliphatic dicarboxylic acid and a mixture of at least one linear or slightly branched $C_2$–$C_{14}$ monocarboxylic acid and at least one saturated, linear or slightly branched aliphatic $C_{15}$–$C_{30}$ monocarboxylic acid. Maximum kinematic viscosity at 98,9 C ($Vk_{,98.9}$) of the complex ester suitably is only 25 cSt, which corresponds to a typical viscosity of a two-stroke oil.

In FR-A-2,187,894, a process for lubricating two stroke engines or rotary engines is disclosed, wherein use is made of a lubricating oil of which the base oil is a complex ester having a kinematic viscosity of more than 6 cSt at 98,9 C. In this reference complex esters are defined as esters formed by condensation of a polycarboxylic acid with a mono- and polyalcohol or as esters' formed by condensation of a polyol with a poly- and monocarboxylic acid. Several examples of complex esters are given: adipate/trimethylolpropane/heptanol having a $Vk_{,98.9}$ of 19,2 cSt, adipate/trimethylolpropane/dodecanoic acid having a $Vk_{,98.9}$ of 13,7 cSt and azelaic acid/pentaerythritollheptanoic acid/dodecanoic acid having a Vk,98.9 of 15,4 cSt. Again, these low viscosities are typical for two-stroke engine oils.

DE-A-2130850 discloses a lubricant composition containing or consisting of at least one low viscosity and one high viscosity component, where the high viscosity component is a complex ester having a kinematic viscosity at 99 C of more than 50 cSt and a flat viscosity-temperature behaviour. The complex esters are obtained by esterification of unbranched dicarboxylic acids having at least 10 carbon atoms with tri- or tetrafunctional alcohols and stopping with monoalcohols of which at least 25% is linear and low molecular. Trimethylolpropane and pentaerythritol are listed as suitable alcohols, whilst n-butanol and n-hexanol are mentioned as suitable low molecular monoalcohol chain stopping agent.

It has been found that complex esters having improved properties can be obtained by selecting certain compounds for use in the production of the complex ester so as to reduce or remove the number of free alcohol and/or carboxylic acid groups in the ester and so terminate the esterification process. Such compounds are hereinafter referred to as "chain stopping agents". We have found that monoalcohols having relatively long carbon chains, i.e. of 14 carbon atoms or more, or monocarboxylic acids having at least 7 carbon atoms provide surprising improvements in properties of the complex esters.

In WO-A-97108277 two categories of ester base stocks for smokeless two stroke engine lubricants are disclosed. The first category are ester base stocks comprising a first ester having a viscosity at 100 C of 2 cSt or less and a second ester having a viscosity such that when the fust and second ester are mixed, the resulting mixture has a viscosity at 100 C of 3.0 to 20.0 cSt and a smoke index of at least 75. The second ester may be a stopped, i.e. chain terminated, or unstopped, i.e. still having some functionality, complex ester. The second category of ester base stocks is formed by one or more esters selected from the group consisting of (a) linear oligoesters having a molecular weight of 3000 Daltons or less, (b) complex, non-hindered polyesters wherein the polyol is a molecule having one or more beta hydrogen atoms, (c) complex, non-hindered polyesters wherein the polyol component is a non-hindered polyol having at least 3 OH groups and (d) esters wherein the polyol component is a hindered polyol and the carboxylic acid is a mono- or polycarboxylic acid or a mixture thereof. Several complex esters of the various categories are described, but most of them have a relatively low kinematic viscosity. The stopped complex ester having the highest kinematic viscosity at 100 C (44,5 cSt) is an ester of trimethylolpropane, dimer acid and oleic acid (C18:1 monoacid) as the chain stopping agent.

However, it has been found that the use of dimer acid, i.e. mainly dimerised fatty acids also comprising some trimerised fatty acids, as the sole polycarboxylic acid component has some disadvantages in terms of interaction with certain additive packages comprising sulphur- and/or phosphorus-containing components. Therefore, it would be advantageous to provide a complex ester not comprising dimer acid as the sole polycarboxylic acid component. Furthermore, it would be advantageous if such stopped complex esters could be provided having high kinematic viscosities at 100 C, i.e. 30 cSt or higher.

The present invention aims to provide a complex ester having a relatively high viscosity, which can be used as a functional fluid itself or in various formulations as a functional fluid, for example a lubricating formulation. Furthermore, and depending on the application, the complex ester should provide high oxidation stability and excellent lubricity, whilst, desirably, possessing good biodegradability characteristics. It will be appreciated that the latter is highly desired in view of the increasing environmental awareness and corresponding demand for environmentally friendly products.

Accordingly, the first aspect of the invention relates to a complex ester obtainable by an esterification reaction between at least one polyfunctional alcohol and at least one polyfunctional carboxylic acid and a chain stopping agent, wherein (a) the polyfunctional alcohol is a hindered or non-hindered, aliphatic polyol, (b) the polyfunctional carboxylic acid comprises an aliphatic dicarboxylic acid containing from 9 to 18 carbon atoms, dimerised and/or trimerised fatty acids or mixtures thereof, with the proviso that dimerised and trimerised fatty acids do not constitute more than 80% by weight, preferably not more than 50% by weight, of the total amount of polyfunctional carboxylic acid used, (c) the chain stopping agent comprises either an aliphatic monocarboxylic acid selected from the group consisting of straight chain saturated acids containing from 7 to 22, preferably from 7 to 14, carbon atoms, branched saturated acids containing from 7 to 24 carbon atoms, straight or branched unsaturated acids containing from 16 to 24 carbon atoms and mixtures thereof or at least one aliphatic, straight or branched, saturated or unsaturated, monofuntional alcohol containing at least 14 carbon atoms, and preferably not having more than 24 carbon atoms, and (d) the complex ester has a kinematic viscosity at 100 C ($Vk,_{100}$) of from 30 to 1000 cSt, preferably from 30 to 200 cSt.

Preferably the complex ester according to the first aspect of the invention is obtained by an esterification reaction between at least one polyfunctional alcohol and at least one polyfunctional carboxylic acid and a chain stopping agent The polyfunctional alcohol preferably is a hindered polyol, more preferably a neopentyl polyol. Examples of suitable neopentyl polyols are neopentyl glycol, dipentaerythritol, trimethylolpropane and pentaerythritol, the latter two being particularly preferred.

The polyfunctional carboxylic acid preferably comprises at least one aliphatic dicarboxylic acid having from 9 to 12 carbon atoms, more preferably selected from nonanedioic acid, decanedioic acid, dodecanedioic acid and mixtures thereof. The presence of dimerised and/or trimerised fatty acids is also considered beneficial provided the amount of such acids does not exceed 80% by weight, preferably 50% by weight, of the total amount of polyfunctional carboxylic acids used. Dimerised and/or trimerised fatty acids may be obtained by subjecting an unsaturated fatty acid-containing feedstock to dimerisation by heat treatment in the presence of a suitable catalyst, as is well known in the art. Suitable unsaturated fatty acid containing sources usually comprise a mixture of unsaturated fatty acids with oleic acid (C18:1) often being the main component beside other mono- and polyunsaturated fatty acids. Dimer acid ("C36di") is produced in substantial quantities in the dimerisation reaction. The final product, which is used for manufacturing the complex esters of the invention, usually is a mixture of dimers and trimers commonly in a dimer/trimer ratio of about 80/20. This mixture contains aliphatic as well as cyclic structures including both naphthenic and aromatic structures. If desired, dimers and/or trimers of high purity (e.g. 95% or more) can be manufactured by molecular distillation of the aforementioned mixture of dimers and trimers. This mixture of dimers and trimers as well as purified dimers and/or trimers can be used as the dimerised and/or trimerised fatty acid component. If desired, the dimerised and/or trimerised fatty acid(s) used can be subjected to hydrogenation prior to being used for forming the complex ester.

Suitably, the polyfunctional carboxylic acid is not dimerised and/or trimerised acid alone, as it was found that this may affect the oxidation performance of for instance a gear oil formulation. It was found that a maximum level of 80% by weight of dimerised and/or trimerised acid, based on total weight of polyfunctional carboxylic acid used, still results in an acceptable oxidation stability. The best results are, however, attained when the dimerised and/or trimerised acid does not constitute more than 50% by weight, more preferably not more than 35% by weight, of the total amount of polyfunctional carboxylic acid used.

The chain stopping agent is used to react with the reactive OH— or COOH-groups, as may be the case, which remain unreacted after reaction between the polyfunctional alcohol and the polyfunctional carboxylic acid. The chain stopping agent should preferably have a relatively long carbon chain for achieving optimum viscosity properties (i.e. a kinematic viscosity at 100 C of at least 30 cSt). In those applications where oxidation stability is very important, such as in gear oil formulations, the chain stopping agent preferably should be saturated. For applications where oxidation stability is less critical, such as for instance in hydraulic fluids, unsaturated fatty acids like olein (technical grade oleic acid) or unsaturated alcohols may also be used. Of the chain stopping agents mentioned above, isostearic acid (isoC18) is very much preferred. However, other fatty acids, like palmitic acid (C16) or stearic acid (C18) are also useful. Furthermore, monocarboxylic acids such as octanoic acid and decanoic acid can also be used. Guerbet acids are also included among the suitable monocarboxylic acids. Examples of suitable monofunctional alcohols are tetradecanol, isotetradecanol, octadecanol and isooctadecanol. Guerbet alcohols are also included among the suitable monofunctional alcohols.

The complex ester according to the present invention should have a $Vk,_{100}$ of from 30 to 1000 cSt and preferably from 30 to 200 cSt. For certain applications, such as in gear oils, it is preferred that the $Vk,_{100}$ has a value of from 100 to 140 cSt. The kinematic viscosity at 40 C ($Vk,_{40}$ of the complex esters suitably has a value in the range of from 230 to 20,000 cSt, more suitably from 230 to 2800 cSt.

The polyol, polyfunctional carboxylic acid(s) and chain stopping agent, which react to form the complex ester, are preferably used in the following amounts depending in the specific materials employed ("pbw" are parts by weight):

15–20 pbw of polyol,

20–25 pbw polyfunctional carboxylic acid and

55–65 pbw chain stopping agent.

The materials are selected so as to provide a complex ester having a $Vk,_{100}$ within the preferred range of from 100 to 140 cSt.

The complex ester according to the present invention can suitably be used in combination with an extreme pressure and/or anti-wear additive (hereinafter EP/AW) containing sulphur and/or phosphorus-containing compounds e.g. in gear oils.

Accordingly, a further aspect of the invention invention relates to a formulation comprising a complex ester as described according to the first aspect of the invention and a sulphur and/or phosphorus-containing EP/AW additive package in a weight ratio of complex ester to additive package of from 1:3 to 9:1. Suitable sulphur and/or phosphorus-containing EP/AW additive packages are well known in the art, particularly for use in gear oils to avoid wear of the gear wheels. Commercially available sulphur-phosphorus-containing EP/AW additive packages are, for instance, manufactured by Ethyl Corporation, Lubrizol and Paramins.

The complex ester according to the invention can be used as a functional fluid in many different applications, for example in lubricating formulations. The ester may be used as a functional fluid or as an additive and/or a base fluid and/or as a thickener in a functional fluid composition.

Thus, the present invention also relates to the use of the complex ester described according to the first aspect of the invention as a functional fluid.

The present invention also relates to functional fluid compositions comprising the complex ester described according to the first aspect of the invention.

The invention also relates to the use of a formulation containing the complex ester as described in the first aspect of the invention as functional fluid composition, such as transmission oils, for example automotive and industrial gear oils, axle oils and automatic transmission fluids, and also in hydraulic fluids, four-stroke oils, fuel additives, compressor oils, greases, chain oils and for metal working and metal rolling applications.

Examples of functional fluids and functional fluid compositions include transmission oils, for example automotive and industrial gear oils, axle oils and automatic transmission fluids, and also in hydraulic fluids, four-stroke oils, fuel additives, compressor oils, greases, chain oils and for metal working and metal rolling applications.

It has been found that the complex ester according to the invention is particularly suitable to be used as a high viscosity base fluid and/or a thickener in multigrade gear oil formulations.

Multigrade gear oil formulations comprising a synthetic thickener are known in the art. Common synthetic thickeners are polyisobutylene (PIB), VI improvers, such as poly (methyl)methacrylate, olefin copolymers and the like, and polyalphaolefins (PAO) having a high kinematic viscosity. An example of a PAO thickener is PAO 100, i.e. a PAO having a $Vk,_{100}$ of about 100 cSt. Such high viscosity PAO is used to obtain the multigrade properties and the desired viscosity, whilst maintaining thermal and oxidation stability. In addition to such PAO a low viscosity ester is normally used to improve the solubility and compatibilty of the additives used, to enhance thermal stability and oxidation stability and to impart the desired low temperature viscosity to the gear oil formulation. An EP/AW additive package is applied to avoid wear of the gear wheels. Finally, a low viscosity (i.e. $Vk,_{100}$ of 4–10 cSt) PAO, also denoted as PAO 4 to PAO 10, and/or a mineral oil having a high viscosity index (VI) is normally present as a base fluid. In case a fully synthetic multigrade gear oil is desired, a low viscosity PAO is used.

It has been found, however, that although the current synthetic multigrade gear oils containing a synthetic thickener perform satisfactorily in a number of demanding applications, there is still a need for improvement to cope with the increasing requirements of modern gear oils such as for heavy duty commercial vehicles and for passenger cars with long drain intervals or filled for life systems. It is an object of the present invention to provide a multigrade gear oil formulation having an improved performance, particularly in gear boxes for heavy duty vehicles, and which also can be fully synthetic, although the latter is not specifically required.

It has been found that by using the complex esters as described hereinbefore as a thickener the above objects can be realised.

Accordingly, the present invention also relates to a multigrade gear oil formulation comprising:

(a) 5–45 pbw of the complex ester as described hereinbefore as a thickener, (b) 5–45 pbw of an ester having a kinematic viscosity at 100 C of 2–10 cSt, (c) 5–60 pbw of a mineral oil having a VI of at least 90 and/or a polyalphaolefin having a kinematic viscosity at 100 C of 4–10 cSt, and (d) 5–15 pbw of the usual gear oil additives, the sum of the amounts of the components (a) to (d) being 100 pbw.

Components (b), (c) and (d) can be any ester, mineral oil and/or polyalphaolefin and additives known to be useful or already used in multigrade gear oil formulations.

Component (b), the low viscosity ester, may be any ester suitable for improving additive solubility and compatibility as well as for improving thermal and oxiation stability and for imparting the desired low temperature viscosity to the gear oil formulation. Preferably, component (b) is an ester of a neopentyl polyol, suitably trimethylolpropane, with at least one aliphatic, saturated monocarboxylic acid having 6 to 12 carbon atoms. An example of such ester is commercially available under the trade name PRIOLUBE 3970.

Component (c) may be a mineral oil or a PAO, which should have a VI of at least 90. It is, however, preferred to use a PAO, particularly PAO 6 and PAO 8.

Component (d) may be any available gear oil EP/AW additive package known to be useful in automotive and industrial gear oil formulations.

The complex esters may be produced in a batch or continuous process. The invention further provides a process for the manufacture of a complex ester which comprises reacting at least one polyfunctional alcohol, at least one polyfunctional carboxylic acid and a chain stopping agent, wherein (a) the polyfunctional alcohol is a hindered or non-hindered, aliphatic polyol, (b) the polyfunctional carboxylic acid comprises an aliphatic dicarboxylic acid containing from 9 to 18 carbon atoms, dimerised and/or trimerised fatty acids or mixtures thereof, with the proviso that dimerised and trimerised fatty acids do not constitute more than 80% by weight, preferably not more than 50% by weight, of the total amount of polyfunctional carboxylic acid used, (c) the chain stopping agent comprises either an aliphatic monocarboxylic acid selected from the group consisting of straight chain saturated acids containing from 7 to 22, preferably from 7 to 14, carbon atoms, branched saturated acids containing from 7 to 24 carbon atoms, straight or branched unsaturated acids containing from 16 to 24 carbon atoms and mixtures thereof or at least one aliphatic, straight or branched, saturated or unsaturated, monofunctional alcohol containing at least 14 carbon atoms, and preferably not having more than 24 carbon atoms, and (d) the complex ester has a kinematic viscosity at 100 C ($Vk,_{100}$) of from 30 to 1000 cSt, preferably from 30 to 200 cSt.

The invention is further illustrated by the following examples without limiting the scope of the invention to these examples.

EXAMPLE 1

Two complex esters were prepared by esterification of the following mixtures:

| Ester A: | Ester B: |
|---|---|
| 19 pbw trimethylolpropane | 18 pbw trimethylolpropane |
| 22 pbw dodecanedioic acid | 18 pbw decanedioic acid |
| 59 pbw isostearic acid | 6 pbw dimer acid |
| | 58 pbw isostearic acid |

Ester A had a $Vk,_{100}$ of 117,0 cSt and a $Vk,_{40}$ of 1360 cSt. Ester B had a $Vk,_{100}$ of 121,6 cSt and a $Vk,_{40}$ of 1445 cSt.

Each complex esters was formulated into a gear oil formulation having the following composition:

| | |
|---|---|
| 30.0 pbw | complex ester A or B |
| 35.8 pbw | PAO 8 |

-continued

| | |
|---|---|
| 25.0 pbw | PRIOLUBE 3970 |
| 9.2 pbw | HITEC 381 (trade mark), a sulphur-phosporus-containing EP/AW additive package sold by Ethyl Corp. |

The formulation containing complex ester A is denoted as Formulation A, the formulation containing complex ester B as Formulation B.

Both Formulations A and B were subjected to a severe screening test being the CEC L48-A-95 (A) oxidation test, also known as the GFC test. This test is widely known and used in the industry to measure the oxidation stability of lubricating oils used in automotive transmissions by artificial ageing.

In the test samples are subjected to oxidation conditions by heating to a temperature of 160 C and by passing air through the samples at a flow rate of 10 litres per hour during a period of 192 hours. However, to increase test severity and to demonstrate the excellent properties of complex esters A and B, the test duration was extended to 300 hours.

The results are indicated in Table 1.

COMPARATIVE EXAMPLE 1

A gear oil formulation (Formulation C) similar to Formulations A and B, only comprising 30.0 pbw of PAO 100 as a thickener instead of a complex ester, was also subjected to the severe screening test of Example 1.

The results are indicated in Table 1.

TABLE 1

Gear oil formulation performance

| Formulation | A | B | C |
|---|---|---|---|
| Change in $Vk,_{100}$ (%) | 9 | 15 | 32 |
| Change in $Vk,_{40}$ (%) | 16 | 24 | 84 |
| Pentane insolubles (%) | 0.11 | 0.15 | 0.65 |
| Toluene insolubles (%) | 0.11 | 0.12 | 0.59 |

From Table 1 it can be seen that formulations A and B show a significantly better performance than Formulation C, both with regard to change of viscosity and insolubles, which indicate that the oxidation stability of Formulations A and B is better than that of Formulation C. During oxidation, namely, viscosity changes and insolubles are formed. The smaller the change in viscosity and the less insolubles are formed, the better the oxidation stability.

EXAMPLE 2

Two other complex esters were prepared by esterification of the following mixtures:

| Ester D: | Ester E: |
|---|---|
| 13 pbw pentaerythritol | 13 pbw pentaerythritol |
| 9 pbw decanedioic acid | 14 pbw dodecanedioic acid |
| 78 pbw isostearic acid | 73 pbw isostearic acid |

Ester D had a $Vk,_{100}$ of 54,0 cSt and a $Vk,_{40}$ of 471 cSt. Ester E had a $Vk,_{100}$ of 93,5 cSt and a $Vk,_{40}$ of 1105 cSt.

Ester D and Ester E were subjected to biodegradation tests according to OECD-Guideline 301 B (modified Sturm test). The test is based on the measurement of $CO_2$ evolution and is a well-known and widely accepted test to measure ultimate biodegradability. Ultimate biodegradability relates to the conversion of the parent molecule to simple molecules such as carbon dioxide, water, inorganic salts and new micro-organisms.

After the prescribed test period of 28 days, Ester D was biodegraded to an extend of 65% and Ester E to an extend of 63%. Based on the OECD 301 B ready biodegradability threshold of >/=60% after 28 days, both Ester D and Ester E may be termed readily biodegradable.

Their ready biodegradability make such esters as Ester D and Ester E well suitable for application in biodegradable greases, biodegradable chain oils, biodegradable hydraulic fluids, biodegradable industrial gear oils and the like. For these applications, the esters may be used as such and/or in combination with other readily biodegradable base fluids such as other complex esters, non-complex esters, polyalphaolefins of both suitable viscosity and biodegradability and certain mineral oil type of base fluids. The formulations containing these product may also contain suitable additives such as antioxidants, anti-wear/extreme pressure additives, metal deactivators, anticorrosion additives, antifoamants, friction modifiers and the like as known in the art.

EXAMPLE 3

Two other complex esters were prepared by esterification of the following mixtures:

| Ester F: | Ester G: |
|---|---|
| 32 pbw neopentylglycol | 35 pbw dipropylene glycol |
| 48 pbw decanedioic acid | 38 pbw dodecanedioic acid |
| 11 pbw octanoic acid | 15 pbw octanoic acid |
| 9 pbw decanoic acid | 12 pbw decanoic acid |

Ester F had a $Vk,_{100}$ of 45,4 cSt and a Vk,40 of 402 cSt. Ester G had a $Vk,_{100}$ of 31,8 cSt and a Vk,40 of 231 cSt.

Ester F and Ester G have a particular polar character as a result of the presence of a high amount of ester groups which results in excellent lubricity, in particular in relation to non-polar base fluids such as mineral oil and/or synthetic hydrocarbons and/or less polar esters. Therefor, such esters as Ester F and Ester G are suitable for use as a base fluid component and/or additive in engine oils to reduce the internal friction of those engines. For this application, the ester s may be used as such and/or in combination with other base fluids such as non-complex esters, polyalphaolefins and mineral oil type of base fluids. The formulations containing these product may also contain suitable additives such as detergents, dispersants, antioxidants, anti-wear/extreme pressure additives, metal deactivators, anticorrosion additives, antifoamants, friction modifiers and the like as known in the art.

EXAMPLE 4

An other complex ester was prepared by esterification of the following mixtures:

Ester H:

26 pbw pentaerythritol 23 pbw hexanedioic acid 51 pbw hexanoic acid Ester H had a $Vk,_{100}$ of 217 cSt and a $Vk,_{40}$ of 3265 cSt. Ester H has a very high affinity to metal surfaces due to the presence of a very high amount of ester groups. Therefor, such an ester is suitable for use as a base fluid component and/or additive in metal working oils to improve the lubricity of the formulation, thereby improving the metal working process. The esters may be used in combination with other base fluids such as other esters, polyalphaolefins and mineral oil type of base fluids. The formulations containing these product may also contain suitable additives such as antioxidants, anti-wear/extreme pressure additives, metal deactivators, anticorrosion additives, antifoamants and the like as known in the art.

EXAMPLE 5

An other complex ester was prepared by esterification of the following mixtures:

Ester I:

23 pbw dipentaerythritol 8 pbw hexanedioic acid 38 pbw octanoic acid 31 pbw decanoic acid Ester I had a $Vk,_{100}$ of 35,5 cSt and a $Vk,_{40}$ of 329 cSt Owing to its high oxidation stability and good lubricity due to the presence of a polar ester groups such an ester is suitable for use as a base fluid component and/or additive for compressor oils and for metal rolling oils. The esters may be used in combination with other base fluids such as other esters, polyalphaolefins and mineral oil type of base fluids. The formulations containing these product may also contain suitable additives such as antioxidants, anti-wear/extrerne pressure additives, metal deactivators, anticorrosion additives, antifoamants and the like as known in the art.

What is claimed is:

1. A complex ester obtained by an esterification reaction between at least one polyfunctional alcohol and a polyfunctional carboxylic acid and a chain-stopping agent, wherein:

(a) said polyfunctional alcohol is a hindered or non-hindered, aliphatic polyol;

(b) said polyfunctional carboxylic acid comprises (1) an aliphatic dicarboxylic acid containing from 9 to 18 carbon atoms and (2) dimerised or trimerised fatty acids or mixtures thereof, provided that dimerised and trimerised fatty acids do not constitute more than 80% by weight of the total amount of polyfunctional carboxylic acid used, (c) said chain-stopping agent comprises either an aliphatic monocarboxylic acid selected from the group consisting of straight chain saturated acids containing from 7 to 22 carbons atoms, branched saturated acids containing from 7 to 24 carbon atoms, straight or branched unsaturated acids containing from 16 to 24 carbon atoms, and mixtures thereof or at least one aliphatic, straight or branched, saturated or unsaturated, monofunctional alcohol containing at least 14 carbon atoms; and (d) the resultant complex ester has a kinematic viscosity at 100° C. ($Vk,_{100}$) of from 30 to 1000 cSt.

2. Complex ester according to claim 1, wherein the polyfunctional alcohol is a neopentyl polyol.

3. Complex ester according to claim 2, wherein the neopentyl polyol is trimethylolpropane or pentaerythritol.

4. Complex ester according to claim 1, wherein the aliphatic dicarboxylic acid has from 9 to 12 carbon atoms.

5. Complex ester according to claim 1, wherein the chain stopping agent is isostearic acid.

6. Complex ester according to claim 1, wherein the complex ester has a kinematic viscosity at 100° C. of from 100 to 140 cSt.

7. Complex ester according to claim 1, wherein the polyol, polyfunctional carboxylic acid and chain stopping agent are used in the following amounts:

15–20 pbw of polyol,

20–25 pbw polyfunctional carboxylic acid and

55–65 pbw chain stopping agent.

8. A functional fluid composition comprising a complex ester as defined in claim 1.

9. A functional fluid composition according to claim 8 which further comprises an additive package containing a sulphur and/or phosphorus-containing extreme pressure and/or anti-wear compound in a weight ratio of complex ester to additive package of from 1:3 to 9:1.

10. Multigrade gear oil formulation comprising:

(a) 5–45 pbw of at least one complex ester according to claim 1 as a thickener, (b) 5–45 pbw of an ester having a kinematic viscosity at 100° C. of 2–10 cSt, (c) 5–60 pbw of a mineral oil having a VI of at least 90 and/or a polyalphaolefin having a kinematic viscosity at 100° C. of 4–10 cSt, and (d) 5–15 pbw of the usual gear oil additives, the sum of the amounts of the components (a) to (d) being 100 pbw.

11. Gear oil formulation according to claim 10, wherein the low viscosity ester is an ester of neopentyl polyol, with at least one aliphatic, saturated monocarboxylic acid having 6 to 12 carbon atoms.

12. Gear oil formulation according to claim 10, wherein component (c) is a polyalphaolefin selected from PAO 6 and PAO 8.

13. Complex ester according to claim 1, wherein (c) chain-stopping agent is said aliphatic monocarboxylic acid.

14. Complex ester according to claim 1, wherein (c) chain-stopping agent is said monofunctional alcohol.

15. Complex ester according to claim 1, wherein the amount of dimerised and/or trimerised fatty acids is not more than 50% by weight, based on the total amount of polyfunctional carboxylic acid.

16. Complex ester according to claim 1, wherein the amount of dimerised and/or trimerised fatty acids is not more than 35% by weight, based on the total amount of polyfunctional carboxylic acid.

17. Complex ester according to claim 16, wherein the aliphatic dicarboxylic acid has from 9 to 12 carbon atoms.

18. Complex ester according to claim 15, wherein the aliphatic dicarboxylic acid has from 9 to 12 carbon atoms.

19. Complex ester according to claim 7, having a kinematic viscosity ($Vk,_{100}$) at 100° C., of from 100 to 140 cSt.

20. A functional fluid composition according to claim 8, which is a lubricating oil, a transmission oil, a gear oil, an axle oil, an automatic transmission fluid, an hydraulic fluid, a four-stroke oil, a fuel additive, a compressor oil, a grease, or a chain oil.

21. A lubricating oil effective for metal working or metal rolling applications comprising the complex ester of claim 1.

22. A functional fluid comprising a thickening effective amount of the complex ester of claim 1.

23. A function fluid comprising the complex ester of claim 1 as base fluid.

24. Functional fluid consisting essentially of the complex ester according to claim 1.

25. Functional fluid consisting essentially of the complex ester according to claim 1, which is a lubricating oil, a transmission oil, a gear oil, an axle oil, an automatic transmission fluid, an hydraulic fluid, a four-stroke oil, a fuel additive, a compressor oil, a grease, or a chain oil.

26. A process for the manufacture of a complex ester which comprises reacting at least one polyfunctional alcohol, a carboxylic acid and a chain stopping agent, wherein (a) the polyfunctional alcohol is a hindered or non-hindered, aliphatic polyol;

(b) the carboxylic acid comprises (1) an aliphatic dicarboxylic acid containing from 9 to 18 carbon atoms, and (2) dimerised or trimerised fatty acids or mixtures thereof, with the proviso that dimerised and trimerised fatty acids do not constitute more than 80% by weight of the total amount of polyfunctional carboxylic acid used, (c) the chain-stopping agent comprises either an aliphatic monocarboxylic acid selected from the group consisting of straight chain saturated acids containing from 7 to 22 carbons atoms, branched saturated acids containing from 7 to 24 carbon atoms, straight or branched unsaturated acids containing from 16 to 24 carbon atoms, and mixtures thereof or at least one aliphatic, straight or branched, saturated or unsaturated, monofunctional alcohol containing at least 14 carbon atoms; and (d) the resultant complex ester has a kinematic viscosity at 100° C. ($Vk,_{100}$) of from 30 to 1000 cSt.

27. Process according to claim 26, wherein the chain stopping agent is an aliphatic monocarboxylic acid selected from the group consisting of straight chain saturated acids containing from 7 to 14 carbons atoms, branched saturated acids containing from 7 to 24 carbon atoms, straight or branched unsaturated acids containing from 16 to 24 carbon atoms, and mixtures thereof.

28. Process according to claim 26, wherein the chain stopping agent is at least one aliphatic, straight or branched, saturated or unsaturated monofunctional alcohol containing from 14 to 24 carbon atoms.

29. Process according to claim 26, wherein the complex ester has a kinematic viscosity at 100° C. ($Vk,_{100}$) of from 30 to 240 cSt.

* * * * *